US010746162B2

(12) United States Patent
Nagura et al.

(10) Patent No.: US 10,746,162 B2
(45) Date of Patent: Aug. 18, 2020

(54) COMPRESSOR

(71) Applicant: Kobe Steel, Ltd., Hyogo (JP)

(72) Inventors: Kenji Nagura, Takasago (JP); Takayuki Fukuda, Takasago (JP); Ryosuke Yamasaki, Takasago (JP); Tomohiro Ootsuka, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 93 days.

(21) Appl. No.: 16/169,189

(22) Filed: Oct. 24, 2018

(65) Prior Publication Data

US 2019/0154022 A1 May 23, 2019

(30) Foreign Application Priority Data

Nov. 20, 2017 (JP) ..... 2017-222445

(51) Int. Cl.

| | |
|---|---|
| ***F04B 25/00*** | (2006.01) |
| ***F04B 25/02*** | (2006.01) |
| ***F04B 37/12*** | (2006.01) |
| ***F04B 39/12*** | (2006.01) |
| ***F04B 25/04*** | (2006.01) |

(52) U.S. Cl.

CPC ..... *F04B 25/005* (2013.01); *F04B 25/02* (2013.01); *F04B 25/04* (2013.01); *F04B 37/12* (2013.01); *F04B 39/123* (2013.01); *F04B 39/125* (2013.01)

(58) Field of Classification Search

CPC ..... F04B 25/005; F04B 25/02; F04B 25/04; F04B 37/12; F04B 53/14; F04B 27/12; F04B 2201/0803; F04B 2201/0208; F04B 39/123; F04B 39/125

See application file for complete search history.

(56) References Cited

U.S. PATENT DOCUMENTS

| | | | | |
|---|---|---|---|---|
| 159,533 A | | 2/1875 | Westinghouse, Jr. | |
| 1,417,571 A | * | 5/1922 | Riesner | F04B 25/02 417/243 |

(Continued)

FOREIGN PATENT DOCUMENTS

| | | | | |
|---|---|---|---|---|
| DE | 1910848 A1 | | 9/1970 | |
| DE | 2454956 A1 | | 5/1976 | |
| WO | WO-2018020925 A1 | * | 2/2018 | F04B 49/065 |

OTHER PUBLICATIONS

Extended European Search Report issued by the European Patent Office dated Mar. 26, 2019, which corresponds to EP18202803.5-1004 and is related to U.S. Appl. No. 16/169,189.

*Primary Examiner* — Nathan C Zollinger

(74) *Attorney, Agent, or Firm* — Studebaker & Brackett PC

(57) ABSTRACT

The present application discloses a compressor including a crank shaft, a first reciprocation converter, a first cylinder body, a first pressurizing portion, a second reciprocation converter, which is connected to the crank shaft with a phase different by 180 degrees from the first reciprocation converter, a second cylinder body, a second pressurizing portion, and a connecting portion configured to interconnect the compression chambers. The compression chambers are arranged so that a timing at which the gas is discharged from a specific compression chamber among the compression chambers becomes the same as a timing at which the discharged gas is suctioned into another compression chamber at a higher side by one stage than the specific compression chamber.

4 Claims, 4 Drawing Sheets

(56) References Cited

U.S. PATENT DOCUMENTS

| | | | | | |
|---|---|---|---|---|---|
| 1,434,135 | A * | 10/1922 | Macfadden | F24D 5/00 | 126/113 |
| 1,467,489 | A * | 9/1923 | Nordberg | F04B 25/02 | 417/248 |
| 2,373,779 | A * | 4/1945 | Ricardo | F04B 25/00 | 417/265 |
| 3,601,505 | A * | 8/1971 | Bratsch | F04B 7/04 | 417/46 |
| 10,087,918 | B2 * | 10/2018 | Okuno | F04B 25/005 | |
| 2015/0125323 | A1 | 5/2015 | Stair et al. | | |
| 2016/0169216 | A1 | 6/2016 | Okuno et al. | | |

* cited by examiner

COMPRESSOR

TECHNICAL FIELD

The present invention relates to a compressor for compressing gas.

BACKGROUND ART

Conventionally multi-stage reciprocating compressors are known. For example, JP 2016-113907 A discloses a compressor including a crank shaft, a first compressing portion configured to compress gas, and a second compressing portion configured to further compress the gas which has been compressed by the first compressing portion. The first compressing portion has first to third compression chambers. The second compressing portion has fourth and fifth compression chambers. The compressor is provided so that a first pressurizing portion linearly reciprocates via a first reciprocation converter and a second pressurizing portion linearly reciprocates via a second reciprocation converter under a rotation of the crank shaft. The gas is thereby compressed in the five compression chambers.

With regard to the compressor disclosed in JP 2016-113907 A, a passage interconnecting the first and second compression chambers requires, for example, a portion (volume) in which gas discharged from the first compression chamber is temporarily stored before the gas discharged from the first compression chamber is suctioned into the second compression chamber because the suction and discharge of the gas is performed simultaneously in the first and second compression chambers. The same may be said for a passage interconnecting the second and third compression chambers as well as a passage interconnecting the fourth and fifth compression chambers.

As described above, during a period from discharge of gas from a compression chamber at a low pressure side to suction of gas into another compression chamber at a high pressure side, the gas temporarily stays in the connecting portion configured to interconnect the compression chambers. The staying gas has a pressure higher than a suction pressure of the compression chamber at the high pressure side, which causes power loss. Adding a volume to the connecting portion in order to avoid the increase in pressure in the connecting portion results in a larger number of parts constituting the connecting portion, which in turn raises a risk of gas leakage. In some cases, such a volume may not be provided because of spatial restrictions.

SUMMARY OF INVENTION

The present invention is made in view of the aforementioned problem. An object of the present invention is to provide a compressor which requires no volume added to a connecting portion interconnecting compression chambers.

A compressor according to one aspect of the present invention includes a first cylinder body having at least two compression chambers which are linearly aligned; a first pressurizing portion configured to compress gas in the at least two compression chambers; a second cylinder body including at least one compression chamber; a second pressurizing portion configured to compress the gas in the at least one compression chamber with a predetermined phase difference between the first and second pressurizing portions; and a connecting portion configured to interconnect the compression chambers. The compression chambers are arranged so that a timing at which the gas is discharged from each compression chamber is concurrent with a timing at which the gas is suctioned to another compression chamber at a higher side by one stage.

The aforementioned compressor requires no volume added to the connecting portion configured to interconnect the compression chambers.

Objectives, features and advantages of the aforementioned compressor will be clarified by the following detailed description and the attached drawings.

DESCRIPTION OF EMBODIMENTS

An exemplificative compressor is described in detail with reference to the drawings.

First Embodiment

Figure 1:
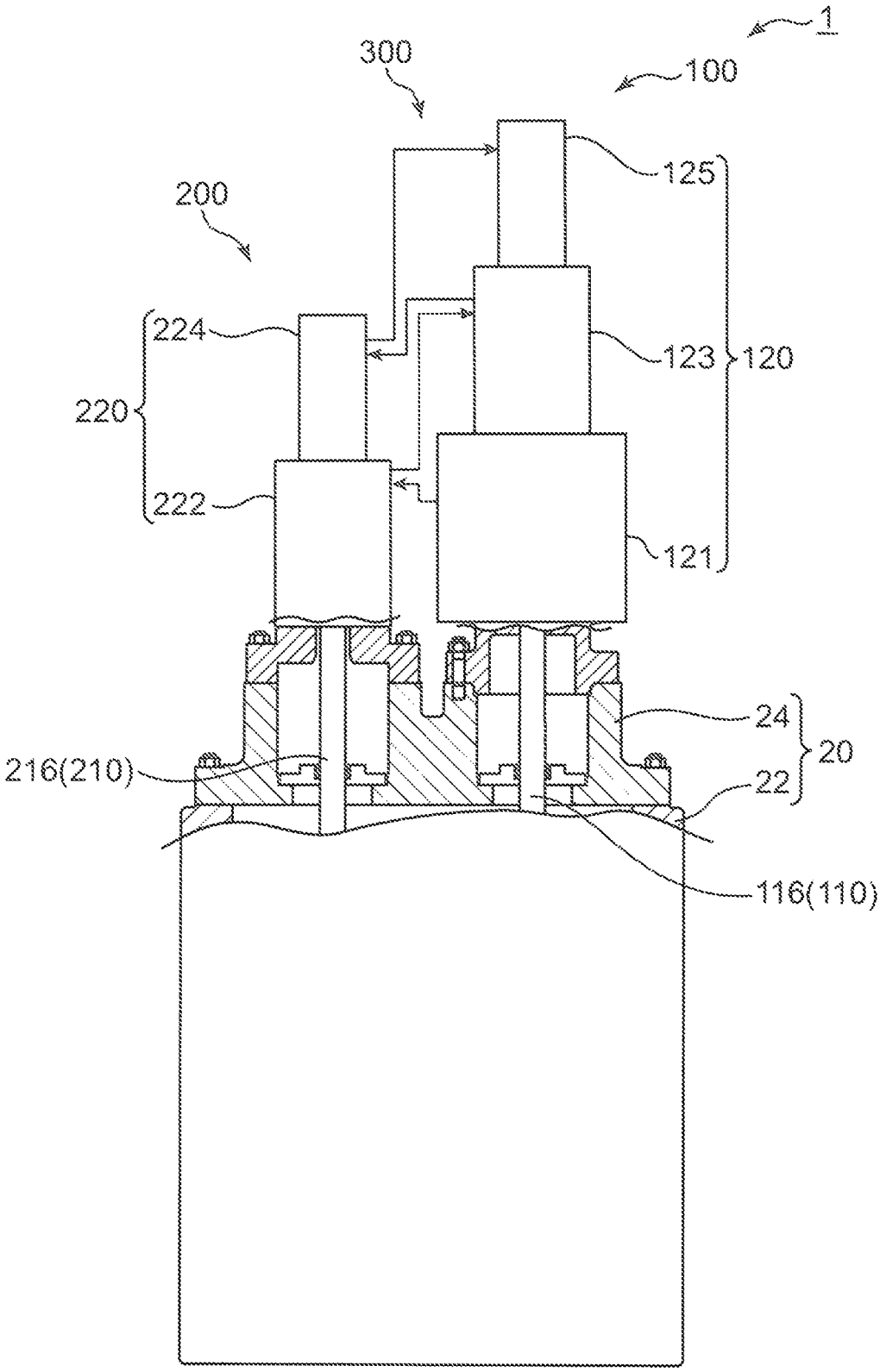
FIG. 1 a schematic view showing a compressor according to the first embodiment.
Figure 2:
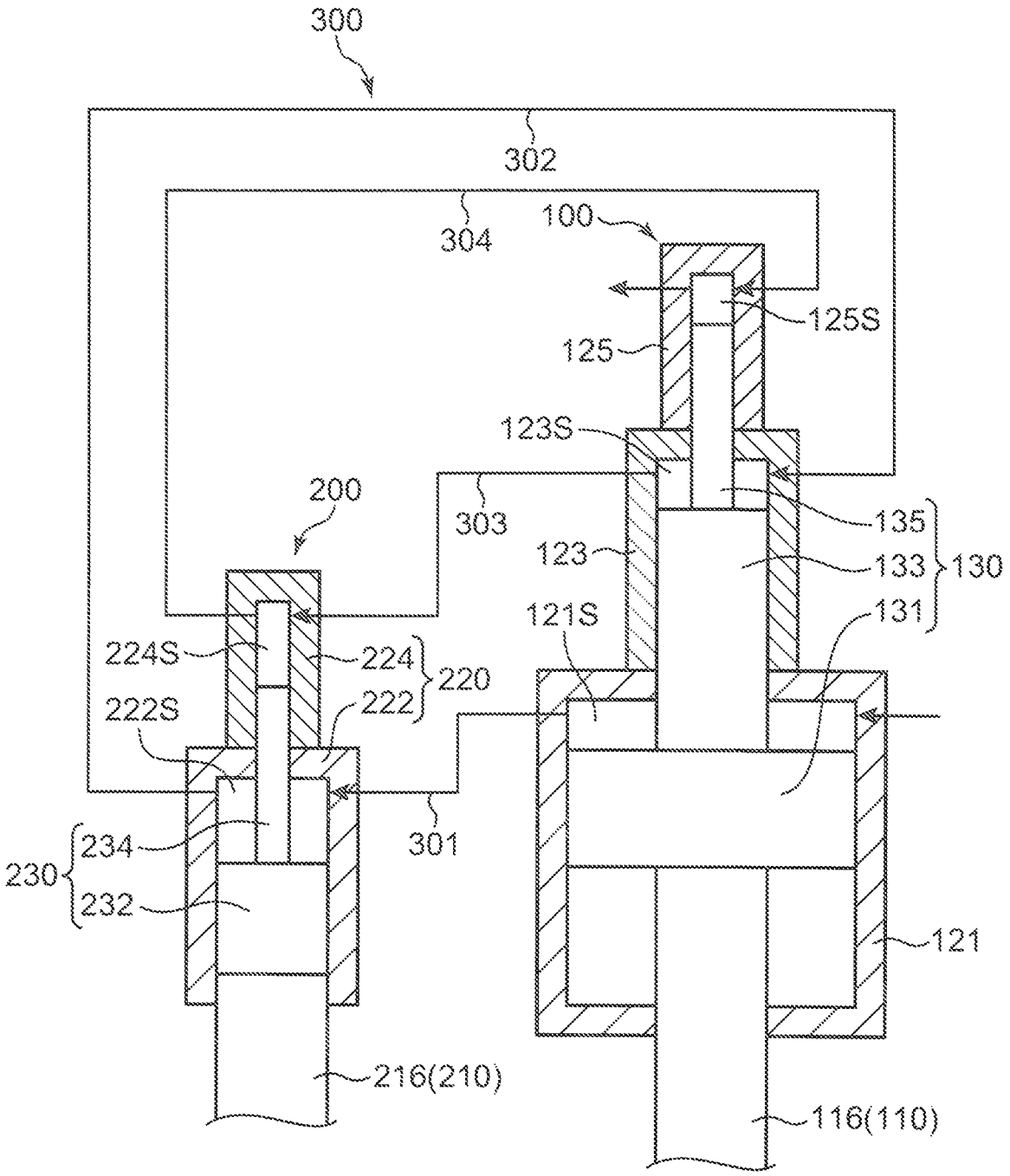
FIG. 2 is a cross-sectional view schematically showing compressing portions of the compressor depicted in FIG. 1.

A compressor 1 according to the first embodiment is described with reference to FIGS. 1 and 2. As shown in FIG. 1, the compressor 1 includes a crank shaft (not shown), a crank case 20, a first compressing portion 100 configured to compress gas, a second compressing portion 200 configured to compress gas and a connecting portion 300. For example, the gas to be compressed is hydrogen. With regard to the present embodiment, the first and second compressing portions 100, 200 extend in the direction of the gravitational force (the vertical direction in FIG. 1). The first and second compressing portions 100, 200 may extend, for example, in the horizontal direction. When the first and second compressing portions 100, 200 extend along the horizontal direction, orientations of the first and second compressing portions 100, 200 in a horizontal plain may be the same directions or the opposite directions. The same may be said for other embodiments described below.

The crank case 20 includes a box-shaped body 22, which is configured to support the crank shaft and opens upward, and a lid portion 24 which closes the opening of the body 22 as shown in FIG. 1.

The first compressing portion 100 includes a first reciprocation converter 110, a first cylinder body 120 and a first pressurizing portion 130 (c.f. FIG. 2).

The first reciprocation converter 110 is connected to the crank shaft (not shown) and linearly reciprocates along a direction perpendicular to the axial direction of the crank shaft (the vertical direction in FIG. 1) under a rotation of the crank shaft.

The first cylinder body 120 includes a first low-stage cylinder 121, a first mid-stage cylinder 123 and a first high-stage cylinder 125. Each of the cylinders 121, 123, 125 is bored to have a form of a hollow cylinder.

The first low-stage cylinder 121 is connected to the top of the lid portion 24. As shown in FIG. 2, the first low-stage cylinder 121 includes a first compression chamber 121S, which is a compression chamber at the lowest stage.

The first mid-stage cylinder 123 is connected to the top of the first low-stage cylinder 121. The first mid-stage cylinder 123 is smaller in inner diameter than the first low-stage cylinder 121. The first mid-stage cylinder 123 includes a third compression chamber 123S, which is a compression chamber at a higher side by two stages than the first compression chamber 121S. The third compression chamber 123S is smaller in volume than the first compression chamber 121S.

The first high-stage cylinder 125 is connected to the top of the first mid-stage cylinder 123. The first high-stage cylinder 125 is smaller in inner diameter than the first mid-stage cylinder 123. The first high-stage cylinder 125 includes a fifth compression chamber 125S, which is a compression chamber at a higher side by two stages than the third compression chamber 123S. The fifth compression chamber 125S is smaller in volume than the third compression chamber 123S. The three compression chambers 121S, 123S, 125S are linearly aligned in the first cylinder body 120.

The first pressurizing portion 130 includes a first low-stage piston 131, a first mid-stage piston 133 and a first high-stage piston 135. The first pressurizing portion 130 is connected to the first reciprocation converter 110.

The first low-stage piston 131 is cylindrical, and is connected to the top end of the first piston rod 116 of the first reciprocation converter 110. The first low-stage piston 131 is situated in the first low-stage cylinder 121. The first low-stage piston 131 compresses the gas in the first compression chamber 121S when the first piston rod 116 moves to one side (an upper side in FIG. 2) along a sliding direction (i.e. the vertical direction in FIG. 2).

The first mid-stage piston 133 is cylindrical, and is connected to the top end of the first low-stage piston 131. The first mid-stage piston 133 is smaller in outer diameter than the first low-stage piston 131. The first mid-stage piston 133 is situated in the first mid-stage cylinder 123. The first mid-stage piston 133 compresses the gas in the third compression chamber 123S when the first mid-stage piston 133 moves to one side (the upper side in FIG. 2) along the sliding direction.

The first high-stage piston 135 is cylindrical, and is connected to the top end of the first mid-stage piston 133. The first high-stage piston 135 is smaller in outer diameter than the first mid-stage piston 133. The first high-stage piston 135 is situated in the first high-stage cylinder 125. The first high-stage piston 135 compresses the gas in the fifth compression chamber 125S when the first high-stage piston 135 moves to one side (the upper side in FIG. 2) along the sliding direction.

With regard to the first compressing portion 100, the pistons 131, 133, 135 slide together in the same direction to simultaneously compress the gas in the first, third and fifth compression chambers 121S, 123S, 125S.

The second compressing portion 200 includes a second reciprocation converter 210, a second cylinder body 220 and a second pressurizing portion 230.

The second reciprocation converter 210 is connected to the crank shaft with a phase difference by 180 degrees from the first reciprocation converter 110. The second reciprocation converter 210 linearly reciprocates along a direction perpendicular to the axial direction of the crank shaft (the vertical direction in FIG. 1) under a rotation of the crank shaft. The phase difference between the second and first reciprocation converters 210, 110 does not have to be 180 degrees exactly. The phase difference may be several degrees to 10 or more degrees (the same may be said for other embodiments). The second reciprocation converter 210 is structurally the same as the first reciprocation converter 110, basically.

The second cylinder body 220 includes a second low-stage cylinder 222 and a second high-stage cylinder 224. Each of the cylinders 222, 224 is bored to have a form of a hollow cylinder. The second low-stage cylinder 222 is connected to the top of the lid portion 24. The second low-stage cylinder 222 includes a second compression chamber 222S. The second compression chamber 222S is a compression chamber at a higher side by one stage than the first compression chamber 121S.

The second high-stage cylinder 224 is connected to the top of the second low-stage cylinder 222. The second high-stage cylinder 224 is smaller in inner diameter than the second low-stage cylinder 222. The second high-stage cylinder 224 includes a fourth compression chamber 224S which is smaller in volume than the second compression chamber 222S. The fourth compression chamber 224S is a compression chamber at a higher side by one stage than the third compression chamber 123S. These two compression chambers 222S, 224S are linearly aligned in the second cylinder body 220.

The second pressurizing portion 230 is connected to the second reciprocation converter 210. The second pressurizing portion 230 includes a second low-stage piston 232 and a second high-stage piston 234.

The second low-stage piston 232 is cylindrical, and is connected to the top end of the second piston rod 216 of the second reciprocation converter 210. The second low-stage piston 232 is situated in the second low-stage cylinder 222. The second low-stage piston 232 compresses the gas in the second compression chamber 222S when the second low-stage piston 232 moves to one side (the upper side in FIG. 2) along the sliding direction (the vertical direction in FIG. 2).

The second high-stage piston 234 is cylindrical, and is connected to the top end of the second low-stage piston 232. The second high-stage piston 234 is smaller in outer diameter than the second low-stage piston 232. The second high-stage piston 234 is situated in the second high-stage cylinder 224. The second high-stage piston 234 compresses the gas in the fourth compression chamber 224S when the second high-stage piston 234 moves to one side (the upper side in FIG. 2) along the sliding direction.

With regard to the second compressing portion 200, the pistons 232, 234 slide together in the same direction to simultaneously compress the gas in the second and fourth compression chambers 222S, 224S.

The connecting portion 300 interconnects the compression chambers. Specifically, the connecting portion 300 includes a first connecting path 301 configured to interconnect the first and second compression chambers 121S, 222S, a first gas cooler (not shown) situated on the first connecting path 301 to cool the gas, a second connecting path 302 configured to interconnect the second and third compression chambers 222S, 123S, a second gas cooler (not shown) situated on the second connecting path 302 to cool the gas, a third connecting path 303 configured to interconnect the third and fourth compression chambers 123S, 224S, a third gas cooler (not shown) situated on the third connecting path 303 to cool the gas, a fourth connecting path 304 configured to interconnect the fourth and fifth compression chambers 224S, 125S, and a fourth gas cooler (not shown) situated on the fourth connecting path 304 to cool the gas. The gas path is thus formed to extend from the first compression chamber 121S to the fifth compression chamber 125S through the second, third and fourth compression chambers 222S, 123S, 224S.

As described above, the second reciprocation converter 210 is provided with the phase difference by 180 degrees from the first reciprocation converter 110. Therefore, a timing at which the gas is suctioned into the second and fourth compression chambers 222S, 224S is concurrent with a timing at which the gas is discharged from the first, third and fifth compression chambers 121S, 123S, 125S. A timing at which the gas is discharged from the second and fourth compression chambers 222S, 224S is concurrent with a timing at which the gas is suctioned into the first, third and fifth compression chambers 121S, 123S, 125S. When the compressor 1 operates, the gas which has been suctioned and compressed in the first compression chamber 121S is discharged from the first compression chamber 121S at the same time as gas suction into the second compression chamber 222S. The gas which has been suctioned and compressed in the second compression chamber 222S is discharged from the second compression chamber 222S at the same time as gas suction into the third compression chamber 123S. The gas in the third compression chamber 123S is discharged and simultaneously suctioned into the fourth compression chamber 224S. The gas in the fourth compression chamber 224S is discharged and simultaneously suctioned into the fifth compression chamber 125S.

With regard to the compressor 1 according to the present embodiment, the compression chambers are arranged so that the gas is discharged from each compression chamber and simultaneously suctioned into another chamber at a higher side by one stage. The term "simultaneously" used for the timing does not have to be construed as precisely the same time. The term "simultaneously" may mean that discharge and suction of gas are performed in parallel during at least a certain period of time (the same may be said for other embodiments). Thus, it is not necessary to temporally store the gas in the connecting portion 300. Therefore, it is not necessary to add a volume to the connecting portion 300.

Second Embodiment

A compressor 1 according to the second embodiment is described with reference to FIG. 3. The second embodiment is described only for portions different from the first embodiment. Description about structures, effects and advantages which are the same as the first embodiment is omitted.

With regard to the present embodiment, a first cylinder body 120 of the first compressing portion 100 includes a first low-stage cylinder 122 and a first high-stage cylinder 124. A second cylinder body 220 of the second compressing portion 200 includes a second low-stage cylinder 223 and a second high-stage cylinder 225.

The first pressurizing portion 130 includes a first low-stage piston 132 and a first high-stage piston 134. The first low-stage piston 132 is situated in the first low-stage cylinder 122. A space shown in FIG. 3 below the first low-stage piston 132 in the first low-stage cylinder 122 is used as the first compression chamber 121S. A space shown in FIG. 3 above the first low-stage piston 132 is used as the second compression chamber 122S, which is a compression chamber at a higher side by one stage than the first compression chamber 121S. The gas in the first cylinder body 120 is compressed in the first compression chamber 121S by the first low-stage piston 132 moving to one side (the lower side in FIG. 3) along the sliding direction. The gas is compressed in the second compression chamber 122S by the first low-stage piston 132 moving to the other side (the upper side in FIG. 3) along the sliding direction.

With regard to the present embodiment, an additional clearance 122*a* at a portion constituting the second compression chamber 122S of the first low-stage cylinder 122 is provided above the top dead point of the first low-stage piston 132. The inner diameter of the additional clearance 122*a* may be smaller than the outer diameter of the first low-stage piston 132. With regard to the first low-stage cylinder 122, a clearance of the additional clearance 122*a* is formed in the second compression chamber 122S when the first low-stage piston 132 reaches the top dead point. This clearance reduces suction efficiency (volumetric efficiency) of the second compression chamber 122S so that an amount of gas discharged from the first compression chamber 121S becomes balanced with an amount of gas suctioned into the second compression chamber 122S in a suitable pressure range (e.g. a compression ratio of the first compression chamber 121S of around 1.5 to 4). The suction efficiency is expressed by the following formulas.

$$\text{Suction Efficiency}=100-\text{Clearance }\%\times A$$

$$\text{Clearance }\%=(\text{Clearance Volume})/(\text{Stroke Volume})\times 100$$

$$\text{Stroke Volume}=(\text{Piston Area})\times(\text{Piston Stroke}) \quad \text{(I)}$$

where "A" is a value depending on a state such as a gas pressure and a gas temperature. The suction efficiency takes a smaller value for a larger clearance.

The first high-stage piston 134 is connected to the top of the first low-stage piston 132 and is situated in the first high-stage cylinder 124. The first high-stage cylinder 124 includes a fourth compression chamber 124S, which is a compression chamber at a higher side by one stage than the third compression chamber 223S that is described below. The gas is compressed in the fourth compression chamber 124S by the first high-stage piston 134 moving to the other side (the upper side in FIG. 3) along the sliding direction.

The pistons 132, 134 simultaneously slide in the same direction, so that the gas is compressed simultaneously in both the second and fourth compression chambers 122S, 124S. Since the first and second compression chambers 121S, 122S are provided in both sides of the first low-stage piston 132, the suction timing and the discharge timing of the first compression chamber 121S are respectively the same as the discharge timing and the suction timing of the second compression chamber 122S.

The second low-stage cylinder 223 of the second compressing portion 200 includes a third compression chamber 223S, which is a compression chamber at a higher stage by one stage than the second compression chamber 122S. The second high-stage cylinder 225 includes a fifth compression chamber 225S connected to the top of the second low-stage cylinder 223. The fifth compression chamber 225S is a compression chamber at a higher side by one stage than the fourth compression chamber 124S.

The second pressurizing portion 230 includes a second low-stage piston 233 and a second high-stage piston 235. The gas is compressed in the third compression chamber 223S by the second low-stage piston 233 moving to the other side (the upper side in FIG. 3) along the sliding direction. The gas is compressed in the fifth compression chamber 225S by the second high-stage piston 235 moving to the other side along the sliding direction. The gas is simultaneously compressed in both the third and fifth compression chambers 223S, 225S. The second reciprocation converter 210 is provided with a phase difference by 180 degrees from the first reciprocation converter 110. The first pressurizing portion 130 compresses the gas in the first compression chamber 121S at the same time as gas compression by the second pressurizing portion 230 in the third and fifth compression chambers 223S, 225S.

The first connecting path 301 interconnects the first and second compression chambers 121S, 122S. The second connecting path 302 interconnects the second and third compression chambers 122S, 223S. The third connecting path 303 interconnects the third and fourth compression chambers 223S, 124S. The fourth connecting path 304 interconnects the fourth and fifth compression chambers 124S, 225S. The gas path is thus formed to extend from the first compression chamber 121S to the fifth compression chamber 225S through the second, third and fourth compression chambers 122S, 223S, 124S.

When the compressor 1 operates, the gas which has been suctioned and compressed in the first compression chamber 121S is discharged from the first compression chamber 121S and simultaneously suctioned into the second compression chamber 122S. The gas which has been suctioned and compressed in the second compression chamber 122S is discharged from the second compression chamber 122S and simultaneously suctioned into the third compression chamber 223S. The gas in the third compression chamber 223S is discharged and simultaneously suctioned into the fourth compression chamber 124S. The gas in the fourth compression chamber 124S is discharged and simultaneously suctioned into the fifth compression chamber 225S.

With regard to the aforementioned embodiment, the compression chambers are arranged so that the gas is discharged from each compression chamber and suctioned into another compression chamber at a higher side by one stage at the same timing. Therefore, an additional volume is not necessary for the connecting portion 300.

The two compression chambers 121S, 122S are provided in the single first low-stage cylinder 122, so that the first cylinder body 120 may be small in comparison to a case where two cylinders are respectively provided in correspondence to the compression chambers 121S, 122S.

Figure 3:
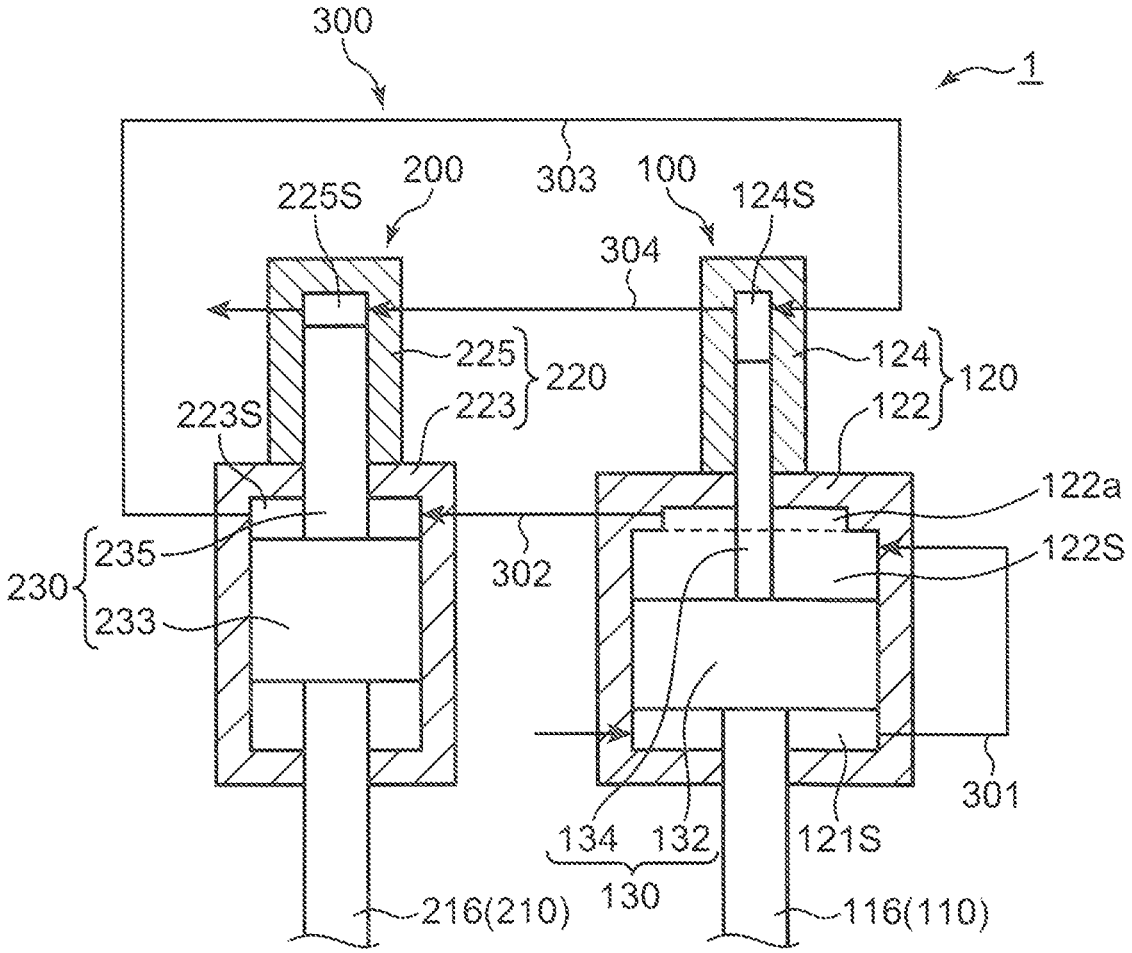
FIG. 3 is a cross-sectional view schematically showing a modification of the compressing portions.
Figure 4:
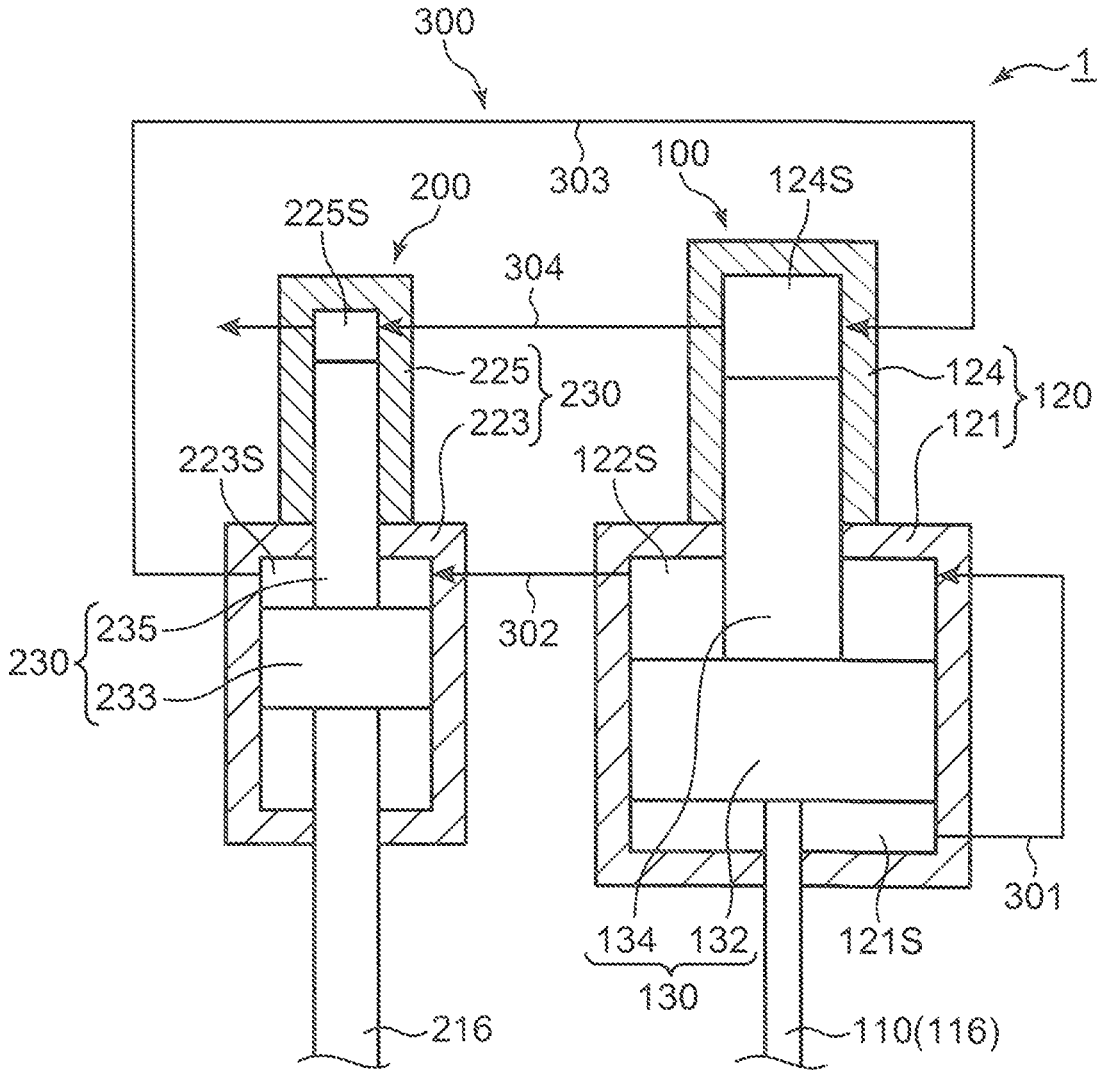
FIG. 4 is a cross-sectional view schematically showing another modification of the compressing portions.

FIG. 4 shows another exemplary embodiment of the compressor 1 shown in FIG. 3. The compressor 1 has no additional clearance 122*a*. The first high-stage piston 134 is larger in outer diameter than the first piston rod 116 of the first reciprocation converter 110. In the first low-stage cylinder 122, a retract stroke volume (a volume in the lower side in FIG. 4) is larger than an advance stroke volume (a volume in the upper side in FIG. 4).

With regard to the retract stroke volume, the piston area expressed by the equation (I) is calculated by subtracting a cross-sectional area of the first piston rod 116 from an area of the first low-stage piston 132. With regard to the advance stroke volume, the piston area expressed by the equation (I) is calculated by subtracting an area of the first high-stage piston 134 from an area of the first low-stage piston 132. The piston area for the advance stroke volume is smaller than that for the retract stroke volume.

Due to the difference in stroke volume between both sides of the first low-stage piston 132, the lower space shown in FIG. 3 in the single first low-stage cylinder 122 may be used as the first compression chamber 121S whereas the upper space shown in FIG. 3 may be used as the second compression chamber 122S.

The present embodiments disclosed in the description should be construed by all means exemplificative and not restrictive. The scope of the present invention is defined by the claims, not by the description on the embodiments, and includes all alterations and modifications within the scope of the meanings equivalent to the claims and within the scope of the claims.

For example, with regard to the embodiments shown in FIGS. 3 and 4, the fourth and fifth compression chambers 124S, 225S may be omitted. If the first cylinder body 120 includes at least two compression chambers whereas the second cylinder body 220 includes one or more compression chambers, the compression chambers may be arranged so that the gas is discharged from a compression chamber and suctioned into another compression chamber at a higher side by one stage at the same timing. Likewise, with regard to the embodiment shown in FIG. 2, the fourth and fifth compression chamber 224S, 125S may be omitted.

The phase difference between the second and first pressurizing portions 230, 130 does not have to be 180 degrees but may suitably be set within a range from 90 degrees to 270 degrees.

The aforementioned embodiments mainly include a compressor with the following configuration.

A compressor according to one aspect of the aforementioned embodiments includes a first cylinder body including at least two compression chambers which are linearly aligned; a first pressurizing portion configured to compress gas in the at least two compression chambers; a second cylinder body including at least one compression chamber; a second pressurizing portion configured to compress the gas in the at least one compression chamber with a predetermined phase difference between the first and second pressurizing portions; and a connecting portion configured to interconnect the compression chambers. The compression chambers are arranged so that a timing at which the gas is discharged from each compression chamber is concurrent with a timing at which the gas is suctioned to another compression chamber at a higher side by one stage.

According to the aforementioned configuration, the compression chambers are arranged so that the gas is discharged from the compression chamber and suctioned into the one stage higher compression chamber at the same timing. Therefore, no additional volume is required for the connecting portion.

With regard to the aforementioned configuration, the first cylinder body may include a first low-stage cylinder having a first compression chamber, which is a compression chamber at a side of a lowest stage among the at least two compression chambers, and a first mid-stage cylinder having a third compression chamber, which is a compression chamber at a higher side by two stages than the first compression chamber. The first pressurizing portion may be configured to simultaneously compress the gas in the first and third compression chambers. The second cylinder body may include a second low-stage cylinder having a second compression chamber as the at least one compression chamber, the second compression chamber being a compression chamber at a higher side by one stage than the first compression chamber. The connecting portion may include a first connecting path configured to interconnect the first and second compression chambers, and a second connecting path configured to interconnect the second and third compression chambers.

According to the aforementioned configuration, a timing at which the gas is discharged from the first compression chamber to the first connecting path becomes the same as a timing at which the gas is suctioned from the first connecting path into the second compression chamber. In addition, a timing at which the gas is discharged from the second compression chamber to the second connecting path becomes the same as a timing at which the gas is suctioned from the second connecting path into the third compression chamber. Therefore, it is not necessary to add a volume to the first and second connecting paths.

With regard to the aforementioned configuration, the second cylinder body may further include a second high-stage cylinder having a fourth compression chamber which is linearly aligned with the second compression chamber, the fourth compression chamber being a compression chamber at a higher side by one stage than the third compression chamber. The second pressurizing portion may be configured to simultaneously compress the gas in the second and fourth compression chambers. The connecting portion may further include a third connecting path configured to interconnect the third and fourth compression chambers.

According to the aforementioned configuration, a timing at which the gas is discharged from the third compression chamber to the third connecting path becomes the same as a timing at which the gas is suctioned from the third connecting path into the fourth compression chamber. Therefore, it becomes possible to further compress the gas in the fourth compression chamber without adding a volume to the third connecting path.

With regard to the aforementioned configuration, the first cylinder body may further include a first high-stage cylinder having a fifth compression chamber which is linearly aligned with the third compression chamber, the fifth compression chamber being a compression chamber at a higher side by one stage than the fourth compression chamber. The first pressurizing portion may be configured to simultaneously compress the gas in the first, third and fifth compression chambers. The connecting portion may further include a fourth connecting path configured to interconnect the fourth and fifth compression chambers.

According to the aforementioned configuration, a timing at which the gas is discharged from the fourth compression chamber to the fourth connecting path becomes the same as a timing at which the gas is suctioned from the fourth connecting path into the fifth compression chamber. Therefore, it becomes possible to compress the gas in the fifth compression chamber without adding a volume to the fourth connecting path.

With regard to the aforementioned configuration, the first cylinder body may include a first low-stage cylinder having a first compression chamber, which is a compression chamber at a side of a lowest stage among the at least two compression chambers, and a second compression chamber, which is a compression chamber at a higher side by one stage than the first compression chamber. The first pressurizing portion may compress the gas in the first compression chamber when the first pressurizing portion moves to one side in the first low-stage cylinder along a sliding direction, and compress the gas in the second compression chamber when the first pressurizing portion moves to another side along the sliding direction. The second cylinder body may include a second low-stage cylinder having a third compression chamber as the at least one compression chamber, the third compression chamber being a compression chamber at a higher side by one stage than the second compression chamber. The second pressurizing portion may compress the gas in the third compression chamber concurrently with the first pressurizing portion compressing the gas in the first compression chamber. The connecting portion may include a first connecting path configured to interconnect the first and second compression chambers, and a second connecting path configured to interconnect the second and third compression chambers.

According to the aforementioned configuration, a timing at which the gas is discharged from the first compression chamber to the first connecting path becomes the same as a timing at which the gas is suctioned from the first connecting path into the second compression chamber. In addition, a timing at which the gas is discharged from the second compression chamber to the second connecting path becomes the same as a timing at which the gas is suctioned from the second connecting path into the third compression chamber. Therefore, it is not necessary to add a volume to the first and second connecting paths. Furthermore, the two compression chambers are provided in the single first low-stage cylinder, so that the first cylinder body may be small in comparison to a case where two respective cylinders are provided in correspondence to the two compression chambers.

With regard to the aforementioned configuration, the first cylinder body may further include a first high-stage cylinder having a fourth compression chamber which is linearly aligned with the second compression chamber, the fourth compression chamber being a compression chamber at a higher side by one stage than the third compression chamber. The first pressurizing portion is configured to simultaneously compress the gas in the second and fourth compression chambers. The connecting portion may further include a third connecting path configured to interconnect the third and fourth compression chambers.

According to the aforementioned configuration, a timing at which the gas is discharged from the third compression chamber to the third connecting path becomes the same as a timing at which the gas is suctioned from the third connecting path into the fourth compression chamber. Therefore, it becomes possible to compress the gas in the fourth compression chamber without adding a volume to the third connecting path.

With regard to the aforementioned configuration, the second cylinder body may further include a second high-stage cylinder having a fifth compression chamber linearly aligned with the third compression chamber, the fifth compression chamber being a compression chamber at a higher side by one stage than the fourth compression chamber. The second pressurizing portion may be configured to simultaneously compress the gas in the third and fifth compression chambers. The connecting portion may further include a fourth connecting path configured to interconnect the fourth and fifth compression chambers.

According to the aforementioned configuration, a timing at which the gas is discharged from the fourth compression chamber to the fourth connecting path becomes the same as a timing at which the gas is suctioned from the fourth connecting path into the fifth compression chamber. Therefore, it becomes possible to compress the gas in the fifth compression chamber without adding a volume to the fourth connecting path.

INDUSTRIAL APPLICABILITY

The aforementioned techniques may be suitably used in the fields where compressed gas is required.

This application is based on Japanese Patent application No. 2017-222445 filed in Japan Patent Office on Nov. 20, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A compressor comprising:

a first cylinder body including at least two compression chambers which are linearly aligned;

a first pressurizing portion configured to compress gas in the at least two compression chambers;

a second cylinder body including at least one compression chamber;

a second pressurizing portion configured to compress the gas in the at least one compression chamber with a predetermined phase difference between the first and second pressurizing portions; and a connecting portion configured to interconnect the compression chambers, wherein the compression chambers are arranged so that a timing at which the gas is discharged from each compression chamber is concurrent with a timing at which the gas is suctioned to another compression chamber at a higher side by one stage, wherein the first cylinder body includes a first low-stage cylinder having a first compression chamber, which is a compression chamber at a side of a lowest stage among the at least two compression chambers, and a first mid-stage cylinder having a third compression chamber, which is a compression chamber at a higher side by two stages than the first compression chamber, wherein the first pressurizing portion is configured to simultaneously compress the gas in the first and third compression chambers, wherein the second cylinder body includes a second low-stage cylinder having a second compression chamber as the at least one compression chamber, the second compression chamber being a compression chamber at a higher side by one stage than the first compression chamber, wherein the connecting portion includes a first connecting path configured to interconnect the first and second compression chambers, and a second connecting path configured to interconnect the second and third compression chambers, wherein the second cylinder body further includes a second high-stage cylinder having a fourth compression chamber which is linearly aligned with the second compression chamber, the fourth compression chamber being a compression chamber at a higher side by one stage than the third compression chamber, wherein the second pressurizing portion is configured to simultaneously compress the gas in the second and fourth compression chambers, and wherein the connecting portion further includes a third connecting path configured to interconnect the third and fourth compression chambers.

2. The compressor according to claim 1, wherein the first cylinder body further includes a first high-stage cylinder having a fifth compression chamber which is linearly aligned with the third compression chamber, the fifth compression chamber being a compression chamber at a higher side by one stage than the fourth compression chamber, wherein the first pressurizing portion is configured to simultaneously compress the gas in the first, third and fifth compression chambers, and wherein the connecting portion further includes a fourth connecting path configured to interconnect the fourth and fifth compression chambers.

3. A compressor comprising:

a first cylinder body including at least two compression chambers which are linearly aligned;

a first pressurizing portion configured to compress gas in the at least two compression chambers;

a second cylinder body including at least one compression chamber;

a second pressurizing portion configured to compress the gas in the at least one compression chamber with a predetermined phase difference between the first and second pressurizing portions; and a connecting portion configured to interconnect the compression chambers, wherein the compression chambers are arranged so that a timing at which the gas is discharged from each compression chamber is concurrent with a timing at which the gas is suctioned to another compression chamber at a higher side by one stage, wherein the first cylinder body includes a first low-stage cylinder having a first compression chamber, which is a compression chamber at a side of a lowest stage among the at least two compression chambers, and a second compression chamber, which is a compression chamber at a higher side by one stage than the first compression chamber, wherein the first pressurizing portion compresses the gas in the first compression chamber when the first pressurizing portion moves to one side in the first low-stage cylinder along a sliding direction, and compresses the gas in the second compression chamber when the first pressurizing portion moves to another side along the sliding direction, wherein the second cylinder body includes a second low-stage cylinder having a third compression chamber as the at least one compression chamber, the third compression chamber being a compression chamber at a higher side by one stage than the second compression chamber, wherein the second pressurizing portion compresses the gas in the third compression chamber concurrently with the first pressurizing portion compressing the gas in the first compression chamber, wherein the connecting portion includes a first connecting path configured to interconnect the first and second compression chambers, and a second connecting path configured to interconnect the second and third compression chambers, wherein the first cylinder body further includes a first high-stage cylinder having a fourth compression chamber which is linearly aligned with the second compression chamber, the fourth compression chamber being a compression chamber at a higher side by one stage than the third compression chamber, wherein the first pressurizing portion is configured to simultaneously compress the gas in the second and fourth compression chambers, and wherein the connecting portion further includes a third connecting path configured to interconnect the third and fourth compression chambers.

4. The compressor according to claim 3, wherein the second cylinder body further includes a second high-stage cylinder having a fifth compression chamber linearly aligned with the third compression chamber, the fifth compression chamber being a compression chamber at a higher side by one stage than the fourth compression chamber, wherein the second pressurizing portion is configured to simultaneously compress the gas in the third and fifth compression chambers, and wherein the connecting portion further includes a fourth connecting path configured to interconnect the fourth and fifth compression chambers.

* * * * *